US010191407B2

(12) United States Patent
Moalem et al.

(10) Patent No.: US 10,191,407 B2
(45) Date of Patent: Jan. 29, 2019

(54) APPLYING A CORRECTIVE VOLTAGE

(71) Applicant: HP INDIGO B.V., Amstelveen (NL)

(72) Inventors: Sasi Moalem, Ness Ziona (IL); Shmuel Borenstain, Neve Daniel (IL); Amit Levi, Ness Ziona (IL); Ronen Friedman, Hod-Hasharon (IL); Moshe Issic, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/545,963

(22) PCT Filed: Apr. 15, 2015

(86) PCT No.: PCT/EP2015/058216
§ 371 (c)(1),
(2) Date: Jul. 24, 2017

(87) PCT Pub. No.: WO2016/165766
PCT Pub. Date: Oct. 20, 2016

(65) Prior Publication Data

US 2018/0017888 A1 Jan. 18, 2018

(51) Int. Cl.
*G03G 15/02* (2006.01)
*G03G 15/00* (2006.01)
*G03G 13/01* (2006.01)

(52) U.S. Cl.
CPC ..... *G03G 15/0266* (2013.01); *G03G 15/5037* (2013.01); *G03G 13/016* (2013.01)

(58) Field of Classification Search
CPC ..... G03G 15/0266
See application file for complete search history.

(56) References Cited

U.S. PATENT DOCUMENTS 4,870,460 A * 9/1989 Harada ..... G03G 15/5037 399/128
5,164,779 A * 11/1992 Araya ..... G03G 15/0216 361/225
5,606,398 A 2/1997 Ender
5,887,218 A * 3/1999 Yuu ..... G03G 15/1605 399/302

(Continued)

FOREIGN PATENT DOCUMENTS

JP S56099357 8/1981
JP S59201067 11/1984

(Continued)

OTHER PUBLICATIONS

Young, Ralph H., "Analytic Modeling of the Discharge of a Unipolar Photoconductor", Research Gate, Jan. 1986, 1 page.

*Primary Examiner* — Clayton E Laballe
*Assistant Examiner* — Jas Sanghera
(74) *Attorney, Agent, or Firm* — HP Inc. Patent Department

(57) ABSTRACT

In one example, a method is described that includes a processor detecting a voltage of a photoconductor layer (103) of a printing device, comparing the voltage of the photoconductor layer (103) to a threshold voltage, and applying a corrective voltage to a charging unit (110) or to a transfer member (104) when the voltage of the photoconductor layer (103) exceeds the threshold voltage.

20 Claims, 5 Drawing Sheets

(56) References Cited

U.S. PATENT DOCUMENTS

| | | | | |
|---|---|---|---|---|
| 5,966,560 | A * | 10/1999 | Kodama | G03G 15/169 399/318 |
| 5,978,616 | A * | 11/1999 | Shin | G03G 15/0266 399/100 |
| 6,498,908 | B2 | 12/2002 | Phillips et al. | |
| 8,548,340 | B2 | 10/2013 | Tomiyasu | |
| 8,737,851 | B2 | 5/2014 | Inukai et al. | |
| 2009/0110438 | A1* | 4/2009 | Tokarski | G03G 15/751 399/159 |
| 2012/0213534 | A1* | 8/2012 | Watanabe | G03G 15/55 399/24 |

FOREIGN PATENT DOCUMENTS

| | | |
|---|---|---|
| JP | S60203968 | 10/1985 |
| WO | WO-2014206497 | 12/2014 |

* cited by examiner

500

APPLYING A CORRECTIVE VOLTAGE

BACKGROUND

Digital printing technologies rely on the adhesion of printing fluid particles to a substrate to produce a printed item. For example, a liquid electro-photography (LEP) press or a dry toner electro-photography (DEP) press may provide for the controlled movement of colorant material, such as toner particles, under the influence of an electric field to create images, such as text, graphics, or pictures, on media.

DETAILED DESCRIPTION

Figure 1:
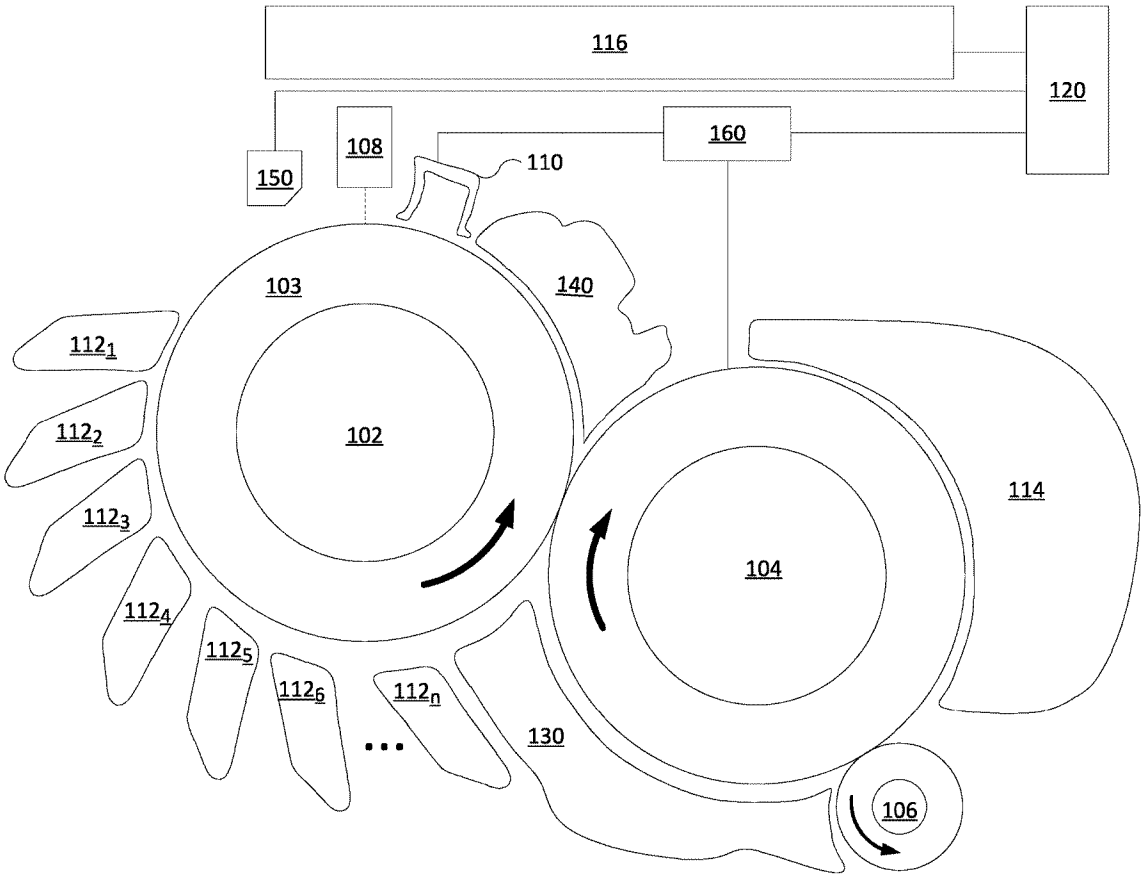
FIG. 1 is a block diagram of an example system of the present disclosure.

In one example, the present disclosure describes a device, method, and non-transitory computer-readable medium for providing a corrective voltage when a voltage of a photoconductor layer of a printing device exceeds a threshold voltage. For example, a processor may detect a voltage of a photoconductor layer of a printing device, compare the voltage of the photoconductor layer to a threshold voltage, and apply a corrective voltage to a charging unit or to a transfer member when the voltage of the photoconductor layer exceeds the threshold voltage.

In another example, the present disclosure describes a device, method, and non-transitory computer-readable medium for providing a corrective voltage when a voltage of a photoconductor layer of a printing device exceeds a threshold voltage. For example, a processor may detect a voltage of a photoconductor layer of a printing device, compare the voltage of the photoconductor layer to a threshold voltage, and apply a corrective voltage to a charging unit when the voltage of the photoconductor layer exceeds the threshold voltage, where the charging unit provides a discharge path for a charge on the photoconductor layer.

In electro-photographic printing devices, a photoconductor layer of a photoconductor imaging plate (PIP) is charged to a high potential, e.g., 1000 volts or more, using a charging unit. In one example, the PIP is mounted to a PIP member, such as a cylinder, drum, or belt. As the PIP member rotates, portions of the photoconductor layer pass the charging unit. A first light source, e.g., a laser unit with a laser, a laser unit with a plurality of lasers, or a light emitting diode (LED) array, then selectively discharges portions of the photoconductor layer, such that the photoconductor layer includes charged areas and non-charged areas. A printing fluid, such as ink or toner, is then transferred to the photoconductor layer and adheres to the areas that have been discharged by the laser unit (or alternatively, to the areas that have not been discharged). For example, the printing fluid may include charged particles to cause the printing fluid to be attracted to discharged or non-discharged areas of the photoconductor layer, depending upon the sign and magnitude of the charge. As the PIP member continues to rotate, the photoconductor layer is then discharged by a second light source, which may be referred to as a pre-transfer erase (PTE) unit, prior to the printing fluid being transferred to a substrate or, in the case of offset printing, to an intermediate transfer member (ITM), which may comprise a drum, a cylinder, a belt, a blanket, and so forth.

The discharging of the photoconductor layer by the PTE prepares the photoconductor layer for a next use and ensures that unsafe voltages are not present in the event that an operator opens the printing device for servicing. However, for a variety of reasons, such as faulty ground connections, a defective light source, and so on, the photoconductor layer may fail to discharge and remain at a high voltage. This may present a risk to the operator. For instance, replacement of the PIP is a common procedure in commercial printing presses. Lingering charge in the photoconductor layer may also lead to poor print quality and degradation of the printing device. In this regard, an operator may be inclined to open the machine and begin troubleshooting print quality issues at the same time that a risk of electric shock is greatest due to the lingering charge on the surface of the photoconductor layer.

To address these issues, the present disclosure detects when an undesirable high voltage remains on the photoconductor layer, e.g., after a print operation, and applies a corrective voltage and provides an alternative discharge path (in lieu of the discharge path to ground via a grounded photoconductor bottom layer, a path that is assumed to be malfunctioning) to cause the voltage of the photoconductor layer to be reduced. The alternative discharge path may be created by reversing the role of the charging unit, e.g., by applying a zero voltage to the charging unit and dynamically modifying its electrical characteristics so as to make the charging unit a ground-connection-equivalent. In another example, the alternative discharge path is provided through the intermediate transfer member (ITM). If the malfunction is not attributed to a faulty discharge path, then, for example, a corrective voltage, such as zero volts relative to ground, may be applied to the charging unit, so as to reduce the voltage of the photoconductor layer. In another example, the corrective voltage may comprise a positive bias voltage applied to an intermediate transfer member (ITM), so as to reduce the voltage of the photoconductor layer. After the application of a corrective voltage, an indication may then be provided that it is safe to open the printing device. These and other aspects of the present disclosure are described in greater detail below in connection with the example FIGS. 1-5.

FIG. 1 illustrates an example printing device, or system 100 of the present disclosure, e.g., a liquid electro-photography (LEP) press. In one example, the system 100 includes a photoconductor imaging plate (PIP) member 102, an intermediate transfer member (ITM) 104, and an impression member 106. In one example, the PIP member 102, ITM 104 and impression member 106 may comprise cylinders or drums that rotate relative to each other to result in the application of printing fluid to a substrate. In one example, the ITM 104 and/or impression member 106 may comprise a blanket, or a blanket mounted over a cylinder, a drum, or the like. Additional components of the system 100 include a light source 108 (e.g., a laser unit), a charging unit 110, a plurality of developers $\mathbf{112}_1$-$\mathbf{112}_n$ (hereinafter collectively referred to as "developers 112"), a heating unit 114, a raster image processor 116, a pre-transfer erase (PTE) unit 130, a cleaning station 140, a voltage measuring unit 150, and a power supply, or voltage source 160. Any of these components may be controlled by a controller 120. The controller 120 may be implemented in a computer, as discussed in connection with FIG. 5. The system 100 may include other components that are not directly pertinent to the present disclosure and are thus omitted for clarity, e.g., a paper tray, a pickup roller, drive rollers, and so forth. Thus, FIG. 1 represents a simplified illustration of the system 100.

The raster image processor 116 comprises a processor that converts a page description of an image to be printed into a mapping, such as a bitmap, that is stored in a memory of the system 100. The page description may be originally encoded in a language such as PostScript, Printer Command Language (PCL), Open Extensible Markup Language Paper Specification (OpenXPS), or other page description language used in two-dimensional or three-dimensional printing prior to being converted into the mapping.

Figure 2:
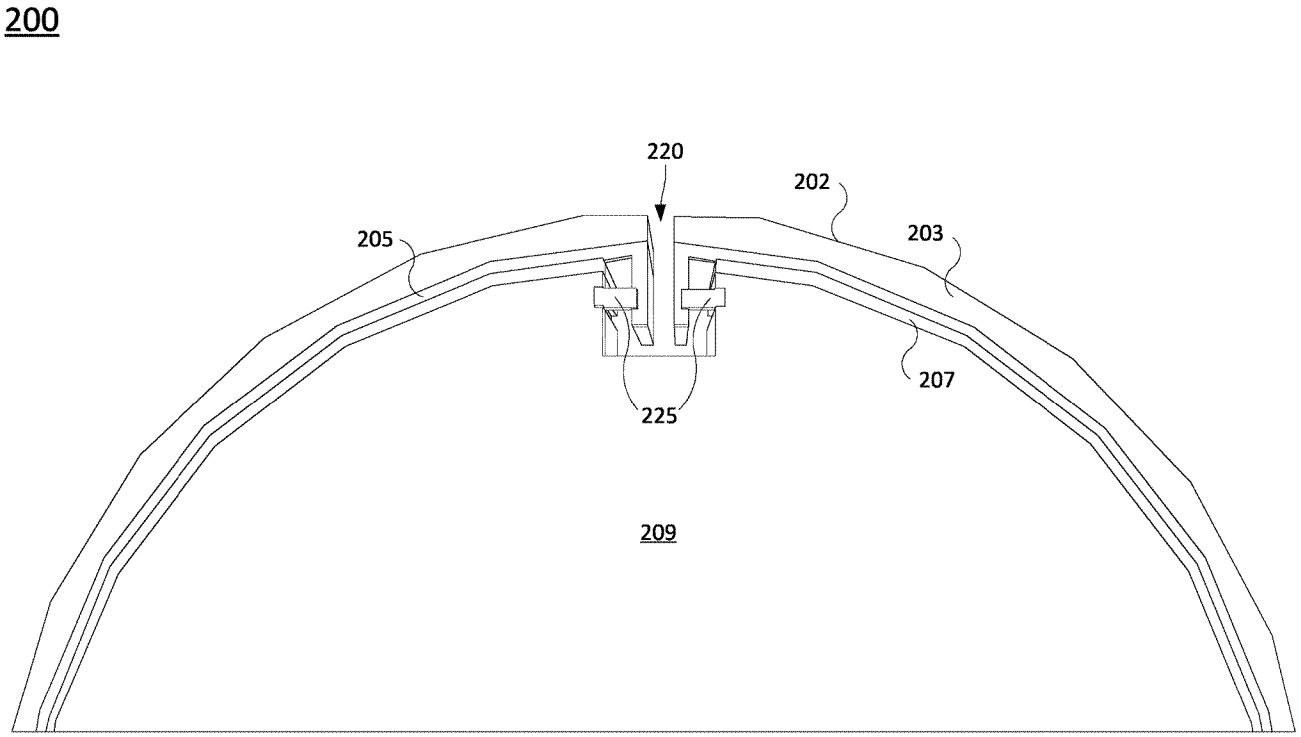
FIG. 2 illustrates an example photoconductor imaging plate (PIP) member.

As illustrated in FIG. 1, the PIP member 102 comprises a cylinder or drum. However, it should be noted that the PIP member 102 is not limited to any particular shape or geometry, and that the example of FIG. 1 is provided for illustrative purposes. In one example, PIP member 102 includes a photoconductor imaging plate (PIP), which may comprise a plurality of layers, including a photoconductor layer 103. For example, FIG. 2 illustrates a portion of a PIP member 200 in greater detail. As shown in FIG. 2, the PIP member 200 includes a PIP, e.g., a foil, which may include a protective layer 202, a photoconductor layer 203, which may represent a same component as photoconductor layer 103 of FIG. 1, a conductive layer 205, such as aluminum, and an insulating layer 207, such as polyethylene terephthalate (PET) or bi-axially oriented PET (BOPET). PIP member 200 may also comprise a core 209. In one example, the PIP foil is removable and attachable from the core 209 and may be mounted to and/or wrapped around an outer surface of the core 209. As illustrated in FIG. 2, PIP member 200 also includes a seam area 220 where the conductive layer 205 is grounded to the core 209 via conductive holders 225.

Returning to a discussion of FIG. 1, the charging unit 110 is positioned in proximity to the PIP member 102 and comprises a unit that projects a uniform electrostatic charge onto the photoconductor layer 103 as the PIP member 102 rotates past the charging unit 110, in the direction indicated by the arrow. In one example, the charging unit 110 comprises a charge roller of a conductive ceramic, rubber, or other material. In another example, the charging unit 110 comprises a scorotron. In one example, the charging unit 110 negatively charges the photoconductor layer 103, e.g., up to 1000 volts or more.

The light source 108 is positioned in proximity to the PIP member 102 and may comprise one laser or a plurality of lasers that are turned on and off by the mapping that is stored in a memory. As the PIP member 102 rotates, photoconductor layer 103 is struck by the laser(s) in selected locations, and the negative charge is discharged from the selected locations. The result is a static electric negative image formed by a pattern of dots on the photoconductor layer 103 of the PIP member 102.

The plurality of developers 112 are positioned in proximity to the PIP member 102, roughly on an opposite side of the PIP member 102 from the charging unit 110. In one example, each of the developers 112 contains a printing fluid of a different color. The printing fluid may comprise, for example, ink, such as liquid electrophotographic ink. Liquid electrophotographic ink comprises a fluid mixture of carrier liquid, such as oil, and concentrated colorant particles. The colorant particles are relatively small and are spaced relatively far apart from each other when the ink is in its dilute liquid form.

In one example, the printing fluid is negatively charged. In one example, the printing fluid is more negatively charged than the areas of the photoconductor layer 103 of the PIP member 102 that were struck by the light from light source 108, i.e., the areas from which the negative charge has been discharged. As a result, the printing fluid is attracted to such areas of the photoconductor layer 103. Thus, as the PIP member 102 continues to rotate, the discharged portions of the photoconductor layer 103 pass the developers 112 where printing fluid from the developers 112 electrically adheres to the areas where the negative charge has been discharged from photoconductor layer 103. In another example, the printing fluid may be positively charged, such that the printing fluid is attracted to areas of the photoconductor layer 103 that have not been exposed to light from the light source 108, i.e., the areas that have not been discharged and retain negative charge.

The pre-transfer erase (PTE) unit 130 may comprise an additional light source, such as one light emitting diode (LED) or a plurality of light emitting diodes, for discharging any negative charge remaining on areas of the photoconductor layer 103. For example, the light source 108 may have selectively discharged areas of the photoconductor layer 103, such that other areas remain negatively charged throughout the process of transferring printing fluid to the PIP member 102. However, once the printing fluid is transferred, all portions of the photoconductor layer 103 may be discharged. In addition, a next rotation of the PIP member 102 may call for a different pattern of charged and uncharged areas to be written to the photoconductor layer 103. Thus, exposure of the photoconductor layer 103 to light from the PTE unit 130 may reset the photoconductor layer 103, e.g., to ground potential or so as to at least eliminate or reduce any lingering negative charge on the surface of the photoconductor layer 103.

As illustrated in FIG. 1, the ITM 104 may comprise a cylinder or drum. In one example, the ITM 104 may comprise a blanket, or may comprise a blanket that is mounted on or supported by a drum, a cylinder, or the like, and may also be referred to as an offset cylinder or a "blanket" cylinder. As illustrated in FIG. 1, the ITM 104 is positioned in proximity to the PIP member 102, roughly at the end of the plurality of developers 112. The ITM 104 contacts the PIP member 102 over a small area. In one example, the ITM 104 rotates in a direction opposite to the direction of rotation of the PIP member 102, as indicated by the arrow. As the PIP member 102 and the ITM 104 rotate relative to one another, the printing fluid on the outer surface of PIP member 102 is transferred to an outer surface of the ITM 104 electrostatically at the small area where the PIP member 102 and the ITM 104 directly contact each other. Any printing fluid or other residue remaining on the PIP member 102 is removed by the cleaning station 140 as the PIP member 102 continues to rotate. In one example, a voltage/potential of ITM 104 is set to assist in the transfer of the charged toner from the photoconductor layer 103 of PIP member 102 to the ITM 104.

In one example, the heating unit 114 is positioned proximate to the ITM 104, roughly on an opposite side of the ITM 104 from the PIP member 102. In one example, the heating unit 114 heats the ITM 104 after the printing fluid has been transferred to the outer surface of the ITM 104. Where the printing fluid comprises liquid electrophotographic ink, the heating may cause the colorant particles to draw closer together. This in turn may cause the texture of the ink to become tacky.

As illustrated in FIG. 1, the impression member 106 may comprise a cylinder, a drum, a blanket, or the like, and may contact the ITM 104. In one example, the impression member 106 rotates in a direction opposite to the direction of rotation of the ITM drum 104, as indicated by the arrow. A substrate upon which an image is to be printed (not shown) may be passed between the ITM 104 and the impression member 106 in the area where the ITM 104 and the impression member 106 contact each other. In one example, as the ITM 104 and the impression member 106 rotate relative to one another, the heated printing fluid is transferred from the outer surface of the ITM 104 onto the substrate as a thin layer. The printing fluid then dries on the substrate, resulting in a printed image.

Various components of system 100 may receive power from power supply 160. In one example, power supply 160 may be controlled by controller 120. Power supply 160 may comprise a high voltage power supply, e.g., capable of generating up to 1000 volts or more, and supplies voltages and currents to the components of system 100. The components supplied by power supply 160 include charging unit 110 and ITM 104. Power supply 160 may further drive other components such as PIP member 102, impression drum 106, developers 112, and so forth. However, for illustrative purposes, no connections other than those between power supply 160 and charging unit 110, and between power supply 160 and ITM 104 are illustrated. For instance, in addition to providing power to various motors to drive the rotations of PIP member 102 and ITM 104, power supply 160 may also be used to raise the voltage/potential of charging unit 110 and ITM 104 to high voltages, e.g., up to 1000 volts or greater, at various times during operation of system 100.

As mentioned above, exposure of the photoconductor layer 103 to light from the PTE unit 130 may reset the photoconductor layer 103, e.g., to ground potential or so as to at least eliminate or reduce any lingering negative charge on the surface of the photoconductor layer 103. Thus, during intended operation, and during a single rotation of the PIP member 102, the photoconductor layer 103 is raised to a high potential via the charging unit 110, certain areas of the photoconductor layer 103 are selectively discharged via the light source 108, and the remaining negatively charged areas of the photoconductor layer 103 are discharged via light from the PTE unit 130.

However, the photoconductor layer's connection to ground may be faulty or may fail for any number of reasons. With reference to FIG. 2, PIP member 200 may represent PIP member 102 of FIG. 1, illustrated in greater detail. For intended operation, the conductive layer 203 is grounded via conductive holders 225 to ground (e.g., the core 209, which may comprise a local ground and/or to the machine ground). The photoconductor layer 203 is charged via a charging unit, e.g., a scorotron or charge roller, and discharged selectively via a light source, e.g., a PTE unit. If the photoconductor layer 203 is not properly installed, the photoconductor layer 203 can be disconnected from ground. In this case, the photoconductor layer 203 may not be properly discharged by the light source. The charge dislocated by the light source is then "trapped" in-place, and the photoconductor layer 203 does not discharge its high voltage.

Referring back to FIG. 1, in another example, the discharge mechanism (irradiation from the PTE unit 130) may fail due to faulty LEDs, blockage of light from the PTE unit 130 to the photoconductor layer 103, and so forth. Thus, the photoconductor layer 103 may remain charged at high voltage, e.g., greater than 200 volts, and up to 1000 volts or more. As such, when an operator replaces or services the PIP of PIP member 102, a frequent procedure in digital press operation, the operator may be exposed to the risk of electrical shock. This may also lead to machine damage and poor print quality images.

In one example, the present disclosure includes a voltage measuring unit 150 in the system 100. Voltage measuring unit 150 may comprise a voltage or charge measuring device for detecting and measuring the voltage of photoconductor layer 103 without contacting the surface of photoconductor layer 103, e.g., a non-contact voltage measuring device. The voltage measuring unit 150 may be used to observe surface voltages during printing operations that utilize PIP member 102. In addition, the voltage measuring unit 150 may be used to observe surface voltages of photoconductor layer 103 after a print job or other use of the system 100 (e.g., a test operation, cleaning operation, etc.) has completed.

In one example, the voltage of the photoconductor layer 103 is monitored after a charge/discharge cycle. For example, the voltage may be measured by voltage measuring unit 150, and the measured voltage may be provided to controller 120. In one example, the controller 120 may compare the measured voltage to a stored threshold. When the voltage of photoconductor layer 103, measured after being discharged by the PTE unit 130, is found to be above a threshold voltage, e.g., above at least 200 volts, above at least 400 volts, above at least 700 volts, and so forth, the photoconductor layer 103 may not be properly grounded, or the PTE unit 130 may be improperly functioning. In this case, controller 120 may cause a corrective voltage to be applied to the charging unit 110 and/or to the ITM 104. In addition, the controller 120 may present a warning to an operator, e.g., via an error message on a display screen, a changing of a color or a blinking pattern of an indicator light, a sound, and so forth. Thus, the operator will be informed to not attempt to touch, service, or replace the PIP of PIP member 102 until notified that it is safe.

It should be noted that the threshold voltage may be selected depending upon various factors. However, when the photoconductor layer 103 is properly discharged, the voltage of the PIP should be below at least 200 volts, and in one example, at or as close as possible to zero volts. On the other hand, if the photoconductor layer 103 is not properly discharged, the voltage of the PIP may remain above a voltage that can cause poor printing due to lingering surface charge, e.g., greater than 200 volts, and can present a risk of an electrical shock to an operator who may touch the PIP. Thus, the present disclosure is not limited to any particular threshold, but broadly encompasses thresholds between a voltage of a discharged state, e.g., greater than zero volts, and a voltage of a fully charged state, e.g., up to 1000 volts or greater. In one example, 200 volts is selected because such a voltage is indicative that the photoconductor layer is not properly discharged, while at the same time avoiding greater risk to the operator, e.g., if the threshold were to be set at 450 volts or greater.

In one example, a corrective voltage may be applied by the controller 120 via the power supply 160. In one example, the corrective voltage may comprise setting the charging unit 110 to zero volts (e.g., relative to ground). In one example, an alternative discharge path (in lieu of the discharge path to ground via a grounded photoconductor bottom layer, a path that is assumed to be malfunctioning) is also provided to cause the voltage of the photoconductor layer 103 to be reduced. The alternative discharge path may be created by reversing the role of the charging unit 110, by applying a zero voltage to the charging unit 110 and dynamically modifying its electrical characteristics so as to make the charging unit a ground-connection-equivalent. In one example, the charging unit 110 may comprise a contact charge roller. In another example, the charging unit 110 may comprise a non-contact charge roller, e.g., a permanent charge roller (PCR) and/or a conductive ceramic charge roller. Non-contact charge rollers may be designed to operate with an air gap between the charge roller and the photoconductor layer 103. However, in one example, the charge roller may be lowered into a position where it contacts the photoconductor layer 103 to provide the alternative discharge path. In another example, the alternative discharge path is provided through the ITM 104. If the malfunction is not attributed to a faulty discharge path, then, for example, a corrective voltage, such as zero volts relative to ground, may be applied to the charging unit 110, so as to reduce the voltage of the photoconductor layer. In another example, the corrective voltage may comprise a positive bias voltage applied to the ITM 104, so as to reduce the voltage of the photoconductor layer 103.

In one example, the controller 120 may continue to monitor the voltage of the photoconductor layer 103, e.g., using voltage measuring unit 150. When the voltage falls to an acceptable low voltage, e.g., at or near zero volts, or at least less than 200 volts, a notification may be provided to an operator, such as a message on a display screen, a changing color of an indicator light, a sound, and so forth. In one example, a notification may also be provided upon a failure of the remedial process to discharge the photoconductor layer 103. In one example, the controller 120 may also halt the operations of system 100. For instance, the failure of photoconductor layer 103 to discharge is indicative of an issue with PTE unit 130, the grounding of photoconductor layer 103, or both. Thus, the system 100 may remain in an unsafe state, and may produce poor print quality output until the cause(s) are addressed.

It should be noted that the example system 100 of FIG. 1 is one example of a printing device that may be used in connection with the present disclosure. For example, the present disclosure may be applied to dry toner electrophotography (DEP) or liquid electro-photography (LEP) printing devices having alternative configurations. For instance, an alternatively configured printing device may comprise a "non-offset" press that includes a PIP member, a charging unit, and other components that are included in the system 100, but may omit an ITM and an impression member. For example, the printing device may instead transfer printing fluid from a PIP member directly to a substrate, without the use of an ITM. In this case, "non-offset" indicates that there is no ITM to transfer a printing fluid-defined image from the PIP member to the substrate. In such an example, the photoconductor layer of the PIP may still fail to discharge and hold an undesirable and/or unsafe voltage. However, in accordance with the present disclosure, a corrective voltage may be applied to the charging unit, since there is no ITM in such a system. In still another example, a system in accordance with the present disclosure may comprise the system 100, but with developers 112 substituted with one or more hoppers with toner particles. Thus, it should be appreciated that the system 100 is one type of representative system, and that the present disclosure is applicable to printing devices of various configurations that utilize a charging unit and a PIP having a photoconductor layer for the transfer of ink or toner.

Figure 3:
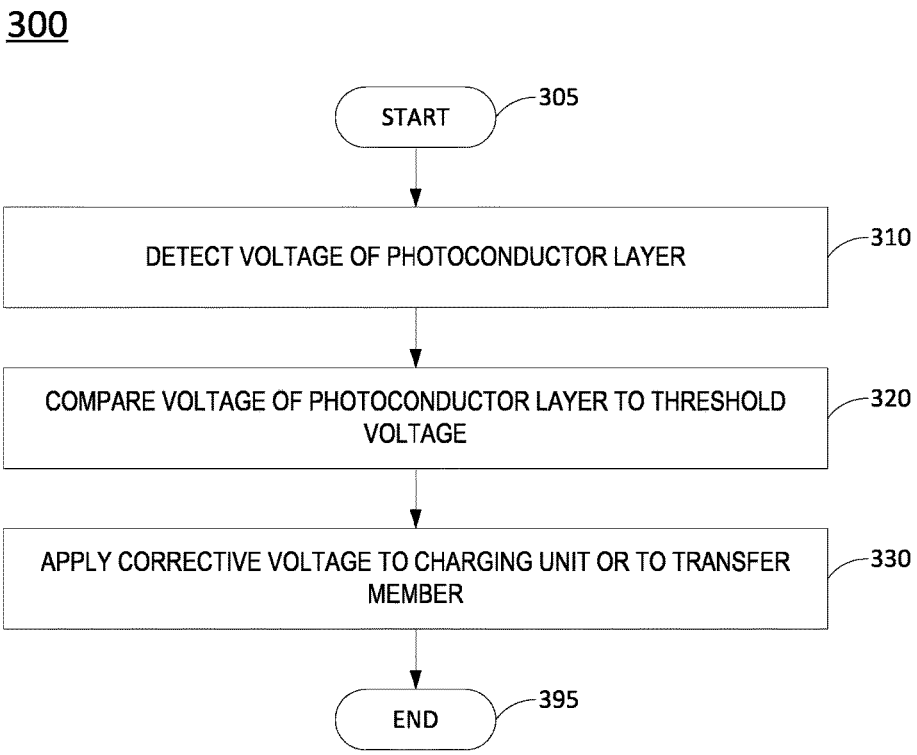
FIG. 3 illustrates a flowchart of an example method for providing a corrective voltage when a voltage of a photoconductor layer of a printing device exceeds a threshold voltage.

FIG. 3 illustrates a flowchart of an example method 300 for providing a corrective voltage when a voltage of a photoconductor layer of a printing device exceeds a threshold voltage. The method 300 may be performed, for example, by any one or more of the components of the system 100 illustrated in FIG. 1. For example, the method 300 may be performed by controller 120 and/or controller 120 in conjunction with power supply 160, voltage measuring unit 150, charging unit 110, and/or ITM 104, and so forth. However, the method 300 is not limited to implementation with the system illustrated in FIG. 1, but may be applied in connection with any number of printing devices having a photoconductor layer, or photoconductor imaging plate (PIP). Alternatively, or in addition, any blocks of the method 300 may be implemented by a computing device having a processor, a memory, and input/output devices as illustrated below in FIG. 5, specifically programmed to perform the blocks of the method. Although any one of the elements in system 100, or in a similar system, may be configured to perform various blocks of the method 300, the method 300 will now be described in terms of an example where blocks of the method 300 are performed by a processor, such as processor 502 in FIG. 5.

The method 300 begins in block 305. In block 310, the processor detects a voltage of a photoconductor layer. The photoconductor layer may comprise a portion of a photoconductor imaging plate (PIP), and may be a component of a PIP member of a printing device. In one example, the voltage of the photoconductor layer is detected via a voltage measuring unit. In one example, the voltage measuring unit comprises a non-contact voltage measuring unit that is near to the surface of the photoconductor layer, without touching the photoconductor layer. In one example, block 310 is performed after a printing operation is completed, or when the printing device is otherwise halted. The voltage measuring unit may be used to sense surface potential/voltage during printing operations. Thus, the voltage measuring unit may be deployed after the lasers impart a latent image to the surface of the photoconductor layer, where "after" is in reference to a direction of rotation of the PIP member for printing operations. However, for purposes of the present disclosure, the voltage measuring unit may be deployed anywhere around the perimeter of the photoconductor layer.

In block 320, the processor compares the voltage of the photoconductor layer to a threshold voltage. For example, after a printing operation or while the printing device is idle, the voltage of the photoconductor layer should be at or near ground potential, e.g., at or near zero volts relative to ground. During printing operations the photoconductor layer may be charged via a charging unit, e.g., a scorotron or charge roller, and discharged selectively via a pre-transfer erase unit (PTE), e.g., a light source, such as an array of LEDs. If the photoconductor layer is not properly installed, the photoconductor layer can be disconnected from ground. Similarly, if the conductive layer or ground connections are not properly installed, or become disconnected or damaged, the photoconductor layer may also be separated from ground. In any of these circumstances, the photoconductor layer may not be properly discharged by the PTE. The charge dislocated by the PTE may then be "trapped" in-place, with the surface potential of the photoconductor layer remaining at a corresponding high voltage. In another example, the discharge mechanism (irradiation from the PTE) may fail due to faulty LEDs, blockage of light from the PTE to the photoconductor layer, and so forth. Thus, the photoconductor layer may remain charged at high voltage, e.g., greater than 200 volts, and up to 1000 volts or more. This presents a danger to an operator of the printing device and may also lead to machine damage and poor print quality images.

The threshold voltage at block 320 is not limited to any particular value, but broadly encompasses thresholds between a voltage of a discharged state, e.g., greater than zero volts, and a voltage of a fully charged state, e.g., up to 1000 volts or greater. In one example, 200 volts is selected because such a voltage is indicative that the photoconductor layer is not properly discharged, while at the same time avoiding increasing risk to the operator, e.g., if the threshold were set at 450 volts or greater. However, it will be appreciated that other voltages within the ranges mentioned herein may be selected.

In block 330, the processor applies a corrective voltage to a charging unit or to a transfer member when the voltage of the photoconductor layer exceeds the threshold voltage. For example, a charging unit, such as a charge roller may be set to zero volts (e.g., relative to ground) in order to reduce the surface potential/voltage of the photoconductor layer. In another example, where the printing device comprises an offset printing device, the corrective voltage may comprise biasing the transfer member, such as an intermediate transfer member (ITM), to a positive voltage to discharge the photoconductor layer. In one example, the corrective voltage is applied by the processor via a power supply/voltage source of the printing device. In one example, an alternative discharge path is also provided for the charge that remains on the photoconductor layer. In one example, the alternative discharge path may be provided by the instruction of the processor. For instance, the charging unit, e.g., a charge roller, may be held or placed in contact with the photoconductor layer in addition to providing the corrective voltage. In another example, the alternative discharge path is provided by the transfer member, which may remain in contact with the photoconductor layer.

Following block 330, the method 300 proceeds to block 395 where the method ends.

Figure 4:
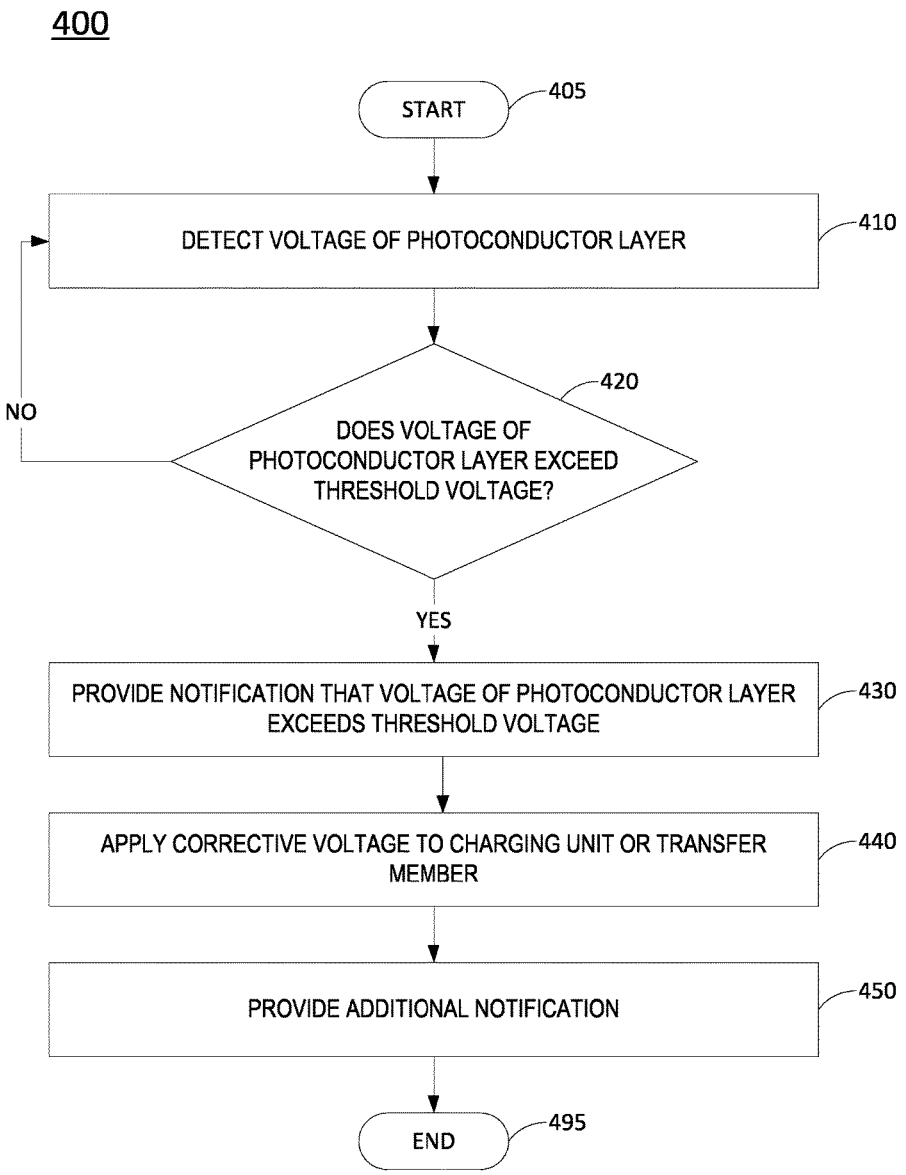
FIG. 4 illustrates a flowchart of an additional example method for providing a corrective voltage when a voltage of a photoconductor layer of a printing device exceeds a threshold voltage.

FIG. 4 illustrates a flowchart of an additional example method 400 for providing a corrective voltage when a voltage of a photoconductor layer of a printing device exceeds a threshold voltage. The method 400 may be performed, for example, by any one or more of the components of the system 100 illustrated in FIG. 1. For example, the method 400 may be performed by controller 120 and/or controller 120 in conjunction with power supply 160, voltage measuring unit 150, charging unit 110, and/or ITM 104, and so forth. However, the method 400 is not limited to implementation with the system illustrated in FIG. 1, but may be applied in connection with any number of printing devices having a photoconductor layer, or photoconductor imaging plate (PIP). Alternatively, or in addition, any blocks of the method 400 may be implemented by a computing device having a processor, a memory, and input/output devices as illustrated below in FIG. 5, specifically programmed to perform the blocks of the method. Although any one of the elements in system 100, or in a similar system, may be configured to perform various blocks of the method 400, the method will now be described in terms of an example where blocks of the method are performed by a processor, such as processor 502 in FIG. 5.

The method 400 begins in block 405. In block 410, the processor detects a voltage of a photoconductor layer. In one example, the voltage of the photoconductor layer is detected via a voltage measuring unit. The voltage measuring unit may comprise a non-contact voltage measuring unit that is near to the surface of the photoconductor layer, without touching the photoconductor layer. In one example, the operations of block 410 may comprise the same or similar operations to those discussed above in connection with block 310 of the method 300.

In block 420, the processor determines whether the voltage of the photoconductor layer exceeds a threshold voltage. In one example, the operations of block 420 may comprise the same or similar operations to those discussed above in connection with block 320 of the method 300. When the voltage of the photoconductor layer does not exceed the threshold voltage, the method may proceed to block 410. Otherwise, when the voltage of the photoconductor exceeds the threshold voltage, the method proceeds to block 430.

In block 430, the processor provides a notification that the voltage of the photoconductor layer exceeds the threshold voltage. In one example, the notification may comprise a warning to an operator, e.g., via an error message on a display screen, a changing of a color or a blinking pattern of an indicator light of the printing device, a sound, and so forth.

In block 440, the processor applies a corrective voltage to address the voltage of the photoconductor layer exceeding the threshold voltage. In one example, the corrective voltage is applied by the processor via a power supply/voltage source of the printing device. The corrective voltage may be applied to a charging unit, such as a charge roller or scorotron. In one example, the corrective voltage may be set to zero volts (e.g., relative to ground) in order to reduce the surface potential/voltage of the photoconductor layer. In another example, where the printing device comprises an offset printing device, the corrective voltage may comprise biasing a transfer member, such as an intermediate transfer member (ITM), to a positive voltage to discharge the photoconductor layer. In one example, an alternative discharge path is also provided for the charge that remains on the photoconductor layer. In one example, the operations of block 440 may comprise the same or similar operations to those discussed above in connection with block 330 of the method 300.

In block 450, the processor provides an additional notification. For example, a second notification may be provided to an operator, such as a message on a display screen, a changing color of an indicator light, a sound, and so forth, indicating that the corrective voltage has been applied and/or that the voltage of the photoconductor layer has fallen below the threshold voltage. In one example, the processor may continue to monitor the voltage of the photoconductor layer in order to determine that the application of the corrective voltage was successful, e.g., by having reduced the voltage of the photoconductor layer to at or near zero volts, or to at least a voltage below the threshold voltage. In one example, a notification may also be provided upon a failure of the application of the corrective voltage to discharge the photoconductor layer. In one example, the notification of block 450 may comprise an instruction to the operator to service the printing device. For example, the operator may be instructed to replace a PIP drum. Alternatively, or in addition, the operator may be instructed to inspect, repair, and/or replace a light source, e.g., a PTE unit, which may be functioning improperly.

Following block 450, the method 400 proceeds to block 495 where the method 400 ends.

It should be noted that although not explicitly specified, one or more blocks, functions, or operations of the methods 300 and 400 described above may include storing, displaying, and/or outputting. In other words, any data, records, fields, and/or intermediate results discussed in the methods can be stored, displayed, and/or outputted to another device depending upon a particular application. Furthermore, block, functions, or operations in FIGS. 3 and 4 that recite a determining operation, or involve a decision, do not necessarily imply that both branches of the determining operation are practiced. In other words, one of the branches of the determining operation can be deemed as optional.

Figure 5:
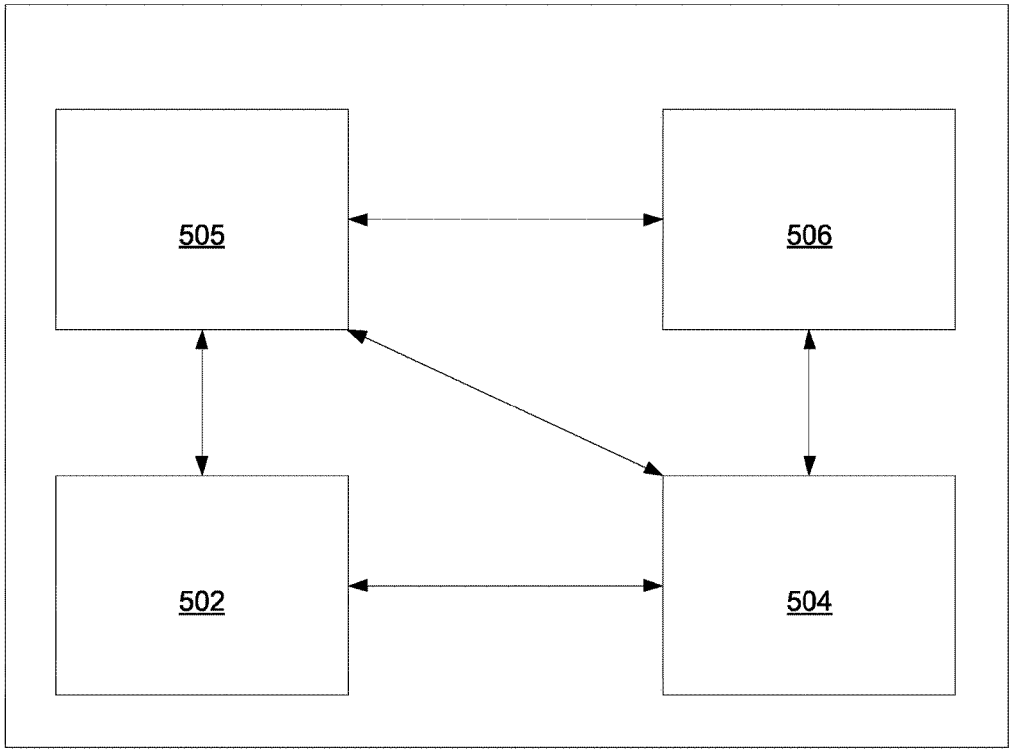
FIG. 5 depicts a high-level block diagram of an example computer that can be transformed into a machine capable of performing the functions described herein.

FIG. 5 depicts a high-level block diagram of a computing device suitable for use in performing the functions described herein. As depicted in FIG. 5, the computer 500 comprises a hardware processor element 502, e.g., a central processing unit (CPU), a microprocessor, or a multi-core processor, a memory 504, e.g., random access memory (RAM), a module 505 for providing a corrective voltage when a voltage of a photoconductor layer of a printing device exceeds a threshold voltage, and various input/output devices 506, e.g., storage devices, including but not limited to, a tape drive, a floppy drive, a hard disk drive or a compact disk drive, a receiver, a transmitter, a speaker, a display, a speech synthesizer, an output port, an input port and a user input device, such as a keyboard, a keypad, a mouse, a microphone, and the like. Although one processor element is shown, it should be noted that the general-purpose computer may employ a plurality of processor elements. Furthermore, although one general-purpose computer is shown in the figure, if the method(s) as discussed above is implemented in a distributed or parallel manner for a particular illustrative example, i.e., the blocks of the above method(s) or the entire method(s) are implemented across multiple or parallel general-purpose computers, then the general-purpose computer of this figure is intended to represent each of those multiple general-purpose computers.

It should be noted that the present disclosure can be implemented by machine readable instructions and/or in a combination of machine readable instructions and hardware, e.g., using application specific integrated circuits (ASIC), a programmable logic array (PLA), including a field-programmable gate array (FPGA), or a state machine deployed on a hardware device, a general purpose computer or any other hardware equivalents, e.g., computer readable instructions pertaining to the method(s) discussed above can be used to configure a hardware processor to perform the blocks, functions, and/or operations of the above disclosed methods.

In one example, instructions and data for the present module or process 505 for providing a corrective voltage when a voltage of a photoconductor layer of a printing device exceeds a threshold voltage, e.g., machine readable instructions can be loaded into memory 504 and executed by hardware processor element 502 to implement the blocks, functions, or operations as discussed above in connection with the example methods 300 and 400. Furthermore, when a hardware processor executes instructions to perform "operations", this could include the hardware processor performing the operations directly and/or facilitating, directing, or cooperating with another hardware device or component, e.g., a co-processor and the like, to perform the operations.

The processor executing the machine readable instructions relating to the above described method(s) can be perceived as a programmed processor or a specialized processor. As such, the present module 505 for providing a corrective voltage when a voltage of a photoconductor layer of a printing device exceeds a threshold voltage, including associated data structures, of the present disclosure can be stored on a tangible or physical (broadly non-transitory) computer-readable storage device or medium, e.g., volatile memory, non-volatile memory, ROM memory, RAM memory, magnetic or optical drive, device or diskette, and the like. Furthermore, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, or variations therein may be subsequently made, which are also intended to be encompassed by the following claims.

What is claimed is:

1. A method, comprising:

detecting a voltage of a photoconductor layer of a printing device, wherein the voltage is detected between an erase operation and a charging operation;

comparing the voltage of the photoconductor layer to a threshold voltage; and applying a corrective voltage to a charging unit when the voltage of the photoconductor layer exceeds the threshold voltage.

2. The method of claim 1, wherein the voltage of the photoconductor layer exceeding the threshold voltage is caused by an improper grounding of the photoconductor layer.

3. The method of claim 1, wherein the voltage of the photoconductor layer exceeding the threshold voltage is caused by a fault in a pre-transfer erase unit.

4. The method of claim 1, wherein the voltage of the photoconductor layer is detected via a non-contact voltage measuring unit.

5. The method of claim 1, further comprising: presenting a notification that the voltage of the photoconductor layer exceeds the threshold voltage.

6. The method of claim 1, further comprising: presenting a notification that the voltage of the photoconductor layer has been reduced after the corrective voltage is applied.

7. The method of claim 1, wherein the erase operation is performed by a pre-transfer erase (PTE) unit.

8. The method of claim 1, wherein the corrective voltage comprises a ground voltage.

9. A device comprising:

a processor; and a computer-readable medium storing instructions which, when executed by the processor, cause the processor to:

detect a voltage of a photoconductor layer of a printing device between an erase operation and a charging operation;

compare the voltage of the photoconductor layer to a threshold voltage;

apply a corrective voltage to a transfer member when the voltage of the photoconductor layer exceeds the threshold voltage: and alert a user to not touch a photoconductor imaging plate (PIP) until the PIP has been discharged.

10. The device of claim 9, further comprising:

a non-contact voltage measuring unit; wherein the instructions to detect the voltage of the photoconductor layer include instructions to detect the voltage of the photoconductor layer via the non-contact voltage measuring unit.

11. The device of claim 9, further comprising:

a power supply; wherein the instructions to apply the corrective voltage to the transfer member include instructions to apply the corrective voltage to the transfer member via the power supply.

12. The device of claim 9, further comprising at least one of:

a photoconductor imaging plate, wherein the photoconductor imaging plate includes the photoconductor layer; or the transfer member.

13. The device of claim 9, wherein the transfer member provides a discharge path for a charge on the photoconductor layer.

14. The device of claim 13, wherein the corrective voltage comprises a positive bias voltage.

15. The method of claim 9, wherein the voltage of the photoconductive layer is detected between a pre-transfer erase (PTE) unit and a charging unit.

16. A method, comprising:

detecting a voltage of a photoconductor layer of a printing device between an erase operation and a charging operation;

comparing the voltage of the photoconductor layer to a threshold voltage; and applying a corrective voltage to a charge roller when the voltage of the photoconductor layer exceeds the threshold voltage, wherein the charge roller provides a discharge path for a charge on the photoconductor layer.

17. The method of claim 16, wherein the voltage of the photoconductor layer is detected via a non-contact voltage measuring unit.

18. The method of claim 16, wherein the corrective voltage comprises a ground voltage.

19. The method of claim 16, wherein the corrective voltage comprises a positive bias voltage.

20. The method of claim 16, wherein the voltage of the photoconductive layer is detected between a pre-transfer erase (PTE) unit and a charging unit.

* * * * *